US007765847B2

(12) United States Patent
Michonski

(10) Patent No.: US 7,765,847 B2
(45) Date of Patent: Aug. 3, 2010

(54) MODULAR POWER PACK ASSEMBLY

(75) Inventor: Richard D. Michonski, Marengo, IL (US)

(73) Assignee: Flextronics AP, LLC, Broomfield, CO (US)

( * ) Notice: Subject to any disclaimer, the term of this patent is extended or adjusted under 35 U.S.C. 154(b) by 325 days.

(21) Appl. No.: 11/934,559

(22) Filed: Nov. 2, 2007

(65) Prior Publication Data

US 2008/0105022 A1 May 8, 2008

Related U.S. Application Data

(60) Provisional application No. 60/864,106, filed on Nov. 2, 2006.

(51) Int. Cl.
*B21D 45/06* (2006.01)

(52) U.S. Cl. ..... 72/344; 72/465.1; 72/466.8

(58) Field of Classification Search ..... 72/54, 72/344, 350, 351, 431, 432, 446, 448, 453.01, 72/453.13, 465.1, 466.7, 466.8; 100/269.02, 100/269.03, 269.04; 83/125, 128, 139
See application file for complete search history.

(56) References Cited

U.S. PATENT DOCUMENTS 268,179 A * 11/1882 Bruce ..... 72/466.9
2,642,916 A * 6/1953 Exline, Jr. ..... 72/466.9
3,457,765 A * 7/1969 Heiser ..... 72/432
3,942,354 A * 3/1976 Randolph, Sr. ..... 72/448
4,056,029 A 11/1977 Doherty et al.
4,111,030 A * 9/1978 Shepard et al. ..... 72/351
4,160,372 A 7/1979 Bergman et al.
4,267,753 A 5/1981 Bennett
4,346,581 A * 8/1982 Ando ..... 72/347
4,520,919 A 6/1985 Keitaro
4,818,210 A * 4/1989 Van Dijk et al. ..... 425/411
4,934,230 A 6/1990 Wallis
4,951,537 A 8/1990 Bennett
5,005,396 A * 4/1991 DeSmet ..... 72/309
5,179,882 A 1/1993 Takeuchi et al.
5,437,436 A 8/1995 Holson et al.
5,640,877 A * 6/1997 Danly, Sr. ..... 72/453.02
6,370,931 B2 4/2002 Bennett
6,691,547 B2 2/2004 Cutshall et al.
7,004,007 B2 * 2/2006 Kruger et al. ..... 72/453.13

* cited by examiner

*Primary Examiner*—Edward Tolan
(74) *Attorney, Agent, or Firm*—Robert G. Crouch; Russell T. Manning; Marsh Fischmann & Breyfogle LLP

(57) ABSTRACT

Provided herein are pressure modules for use with die pressing operations for stripping work pieces from individual dies. The pressure modules include a top plate and a transfer plate that is separated by a resilient member that is compressed when a die set is closed and which provides a restoring force when the die set is opened. The pressure modules are formed independent of the dies and supported relative to the ram or press-bed of the press. In this regard, transfer pins may be utilized to transfer the restoring force from the resilient member to a stripper mechanism. In another arrangement, a press is provided that allows the pressure modules to be removed from or inserted into the press without removing a die attached to the press.

9 Claims, 6 Drawing Sheets

MODULAR POWER PACK ASSEMBLY

CROSS-REFERENCE TO RELATED APPLICATION

This application claims priority under 35 U.S.C. 119 to U.S. Provisional Application No. 60/864,106, entitled: "MODULAR POWER PACK ASSEMBLY," filed on Nov. 2, 2006, the contents of which are incorporated herein as if set forth in full.

FIELD OF INVENTION

Disclosed herein are embodiments of a device for use with, for example, progressive and/or stage-style metal stamping presses to provide stripping pressure for the metal forming/shaping dies of the press. More specifically, the device permits the exchange of individual pressure devices that provide stripping pressure for individual dies.

BACKGROUND OF THE INVENTION

For press systems that are utilized for metal forming, a ram is typically driven towards and away from a press bed such that, in use, a tool that is mounted between the ram and the press bed deforms a work piece. Generally, the tool, or die, comprises two parts known as die sets. In use, these die sets are generally attached one part to the ram and the other part to the press bed. Typically, these die sets includes guides for holding/clamping and/or aligning the work piece.

The ram of the press may be reciprocated by means of crankshaft acting through a connecting rod where the crankshaft is driven by a motor through a clutch and/or a flywheel. Alternately, hydraulics may be utilized as well. In any arrangement, the press ram is advanced towards the press bed and work piece is deformed by the die sets mounted therebetween.

It will be appreciated that different dies are required for different pressing operations. In this regard, a plurality of dies may be mounted between the ram and press bed of a single press. Further, a single work piece may progress from die to die in the press in order to be formed into a completed part. In this regard, different dies on the press may perform different forming/stamping functions. For instance, some dies may be operative to bend or otherwise fold a work piece while other dies may cut or punch the work piece.

In many instances, it may become necessary to forcibly remove the work piece from a die after pressing. That is, it may become necessary to strip the work piece from the die such that additional work may be done to the work piece and/or the work piece may be removed from the press. In this regard, it has been common practice to utilize individual dies that are equipped with an individual pressure module (e.g., stripping module or power pack) that is built into the die. The pressure module compresses when the ram is advanced to the press bed. Upon the ram being retracted from the press bed, the pressure module is operative to expand and, thereby, apply a force (i.e., stripping force) that may remove a work piece from the die. Such pressure modules may be in the form of compression springs, rubber stripper tubes or self-contained nitrogen cylinders (e.g., found in a punch holder).

Incorporation of the pressure module/stripper into individual dies has several drawbacks. For instance, incorporation of an individual stripper into or onto each individual die increases the cost of each die set. Further, if it becomes desirable to increase or decrease the pressure exerted by the pressure module/stripper (e.g., to accommodate different metals and/or metal thickness, etc.), the entire die must be removed from the press and disassembled in order to access the pressure module. At such time, components of the pressure module may be removed from the die in order to replace those components with different sized components. In instances where one or more nitrogen cylinders are utilized, adjustability of the pressure exerted by the cylinders may be simplified. However, such a nitrogen pressure modules are typically too expensive to utilize with every die/tool constructed.

It is against this background and with the desire to improve the adjustability of pressure modules/strippers within a metal pressing system that the present modular power pack assembly has been developed.

SUMMARY OF THE INVENTION

It has been recognized that it would be desirable to remove pressure modules from individual dies and mount those pressure modules to the ram or press-bed of a press such that standard dies (i.e., not including a build on power-pack) may be utilized with the press mounted pressure module. Further, it has been recognized that it would be desirable for an individual pressure module to be removable from the press without removing the die to which the pressure module provides a stripping force. In this regard such a removable pressure module may be conveniently replaced with, for example, a differently sized pressure module and/or the pressure module may be serviced. Further, in some arrangements it may be desirable to utilize a plurality of removable pressure modules.

In a first aspect, a pressure module is provided for use in a die press application. Such a pressure module or power pack may be utilized to provide stripping pressure to a die (e.g., a standard die) utilized with the press. The pressure module includes a top plate and a transfer plate that is spaced from the top plate. At least one connecting member and more typically multiple connecting members extend between the top plate and the transfer plate. Typically, the connecting members are fixedly connected to the top plate and pass through the transfer plate. In this regard, the transfer plate may be operative to move along the connecting members. Furthermore, the connecting members may include an end stop that prevents removal of the transfer plate from the connecting members. The pressure module further includes at least one resilient member that is disposed between the top plate and the transfer plate.

In an uncompressed state, the resilient member may maintain the transfer plate adjacent to the end stop(s) of the connecting members. In a second orientation, the transfer plate may be disposed along the length of the connecting members and thereby compress the resilient member. As will be appreciated, such compression may be in response to being compressed during a die pressing operation. Furthermore, upon release of a press, the compressible member may expand to its original length and thereby provide a restoring force that may be transmitted via the transfer plate to a stripper mechanism.

In one arrangement, the resilient member comprises a passive member. That is, the resilient member may be formed of a self-contained member that provides a restoring force upon release of pressure between the top plate and the transfer plate. In one arrangement, such a passive resilient member may be formed of rubber or urethane. In another arrangement, such a passive member may be formed of a self-contained gas cylinder. In a further arrangement, the resilient member may be formed of an active member. In one such arrangement, the active member may include a gas cylinder that may be selectively interconnected (e.g., via a manifold) to a source of pressurized gas (e.g., nitrogen). However, it will be appreciated that other fluid sources (e.g., hydraulic) may be utilized as well. In arrangements that utilize active resilient members, such modules may further include couplers that allow for interconnecting two or more adjacent pressure modules together. For instance, such couplings may include quick connect fluid couplings.

In one arrangement, the resilient member is removable from between the top plate and the transfer plate. For instance, while the resilient member is in an uncompressed orientation, it may be slidably removed from between the plates. This may allow for selectively replacing a resilient member with a different resilient member. In this regard, compressibility and hence restoring force provided by the pressure module may be selected for a particular application.

In another aspect, a press is provided for use in a die pressing operation. Such a press may include a press bed and a ram that is disposed in a spaced relationship to the press bed. It will be appreciated that the ram may be moveable between a first position and a second position relative to the press bed (e.g., to apply compressive force between die sets mounted therebetween). Fixedly mounted to one of the press bed or the ram are at least two parallel mounts. In further arrangements, a plurality of parallel mounts may be mounted to the press bed or ram. In any case, a first end of these parallel mounts is affixed to the press bed or ram and facing side surfaces of each set of parallel mounts define a channel therebetween. Furthermore, a second end surface of these parallel mounts defines a reference plane as well as provides a surface to which die tooling may be interconnected. The system further includes at least one pressure module that is sized for slidable receipt within the channel formed by the parallel mounts. In one arrangement, a biasing member (e.g., transfer plate) of the pressure module is disposed proximate to (e.g. adjacent/parallel) to the reference plane defined by the second ends of the mounts.

Such a pressure module may include a top plate and a transfer plate as well as a resilient member disposed therebetween. In one arrangement, the height of the pressure module between the outside surfaces of the top plate and transfer plate is substantially equal to the distance between the reference plane and the surface of the press bed or ram to which the parallel mounts are mounted.

By sizing the pressure module for slidable receipt within the channel, such pressure module(s) may be inserted and/or removed from the channel without removing die tooling that may be interconnected to the parallel mounts. In this regard, servicing of the pressure modules (e.g., adjusting or changing resilient and/or compressible members contained by the pressure modules) may be performed without removing die tooling from the press. In one arrangement, a die plate may be fixedly interconnected to the second ends of the parallel mounts. In such an arrangement, the die plate may include one or more apertures that allow for transfer pins to extend therethrough and hence extend between, for example, a stripper plate and the transfer plates of individual pressure modules. In such an arrangement, the die plate may be operative to maintain the pressure modules within the channel. In another arrangement, the lateral facing surfaces of the parallel mounts may be shaped to receive and vertically restrain the pressure module therein. For instance, in one arrangement, a shelf (e.g., a lip or groove) formed on or within the lateral surfaces may be sized to engage and vertically restrain the pressure module (e.g., top plate) and thereby support the pressure module therein.

DETAILED DESCRIPTION

Reference will now be made to the accompanying drawings, which assist in illustrating the various pertinent features of the present invention. Although described primarily herein in conjunction with progressive and stage-style metal stamping presses, it should be expressly understood that certain aspects of the invention may be applicable to other press applications. In this regard, the following description is presented for purposes of illustration and description. Furthermore, the description is not intended to limit the embodiments to the forms disclosed herein. Consequently, variations and modifications consistent with the following teachings, in skill and knowledge of the relevant art, are within the scope of the present application.

As discussed herein, a modular pressure module or "power pack" system is provided. The system is based at least in part on the recognition that it would be desirable to remove pressure modules/pressure strippers (hereinafter "power packs") from individual dies and mount those power packs to the ram or press-bed of a press. A die punch holder may then be mounted beneath or above the pressure modules such that one or more pressure modules are mounted between the press ram/press-bed and the die punch holder. The die punch holder may include plurality of apertures or holes that allow for transfer pins to extend through the die punch holder to the pressure module. These transfer pins may be utilized to eject parts from the die. That is, the transfer pins may compress the pressure module when the press ram is advanced against the press bed. Upon opening the press ram, the pressure module may expand, pushing the transfer pin and thereby strip a work piece from the die. Of further note, the power packs may be releasably interconnected between the die punch holder and the press ram. In such an arrangement, the power pack may be removed from the press without necessitating removal of the dies, as will be more fully discussed herein.

Figure 1:
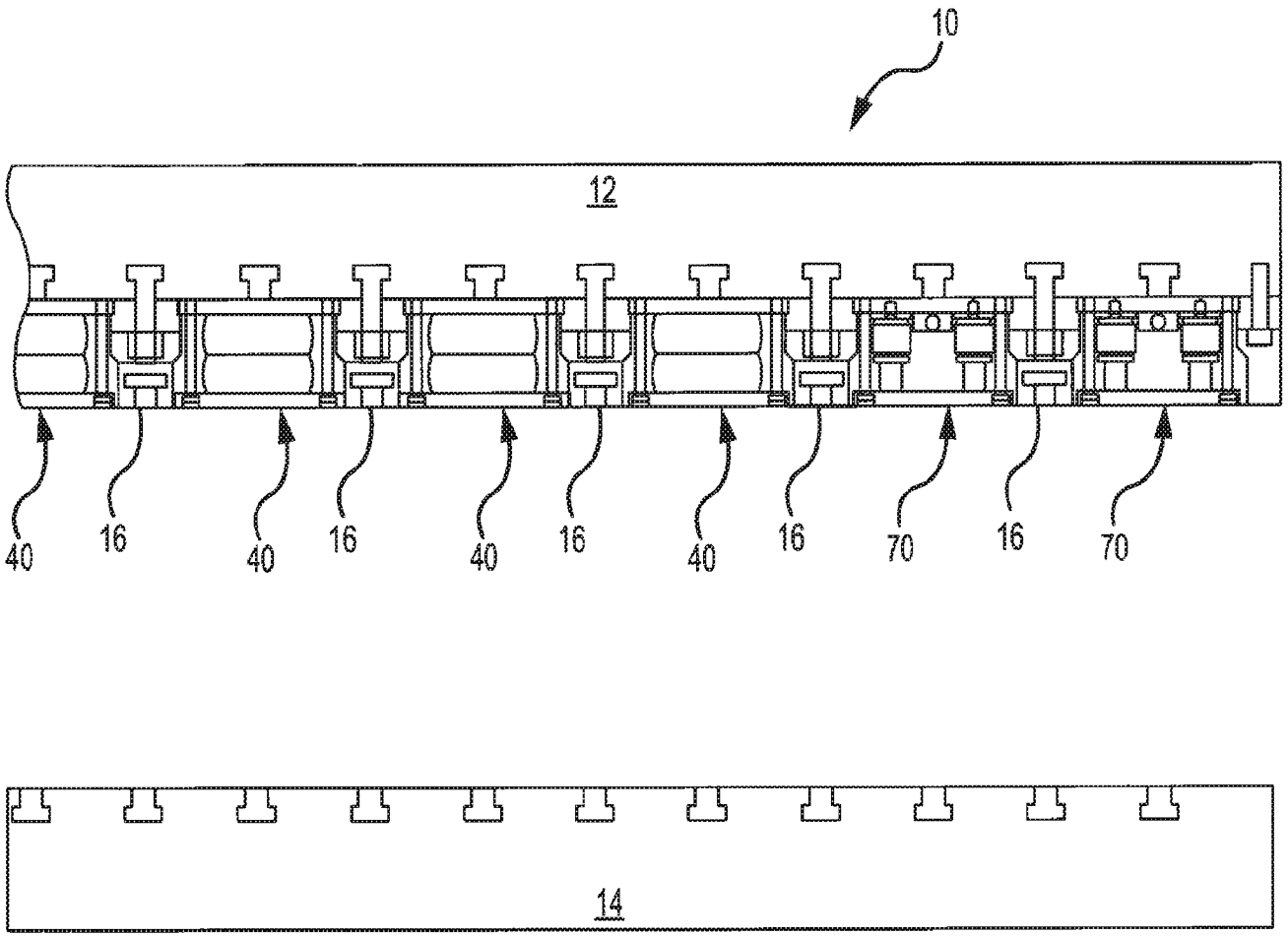
FIG. 1 illustrates a press incorporating removable/modular power packs.

FIG. 1 illustrates a press 10 having a plurality of module power packs 40 releaseably connected to the ram 12. As shown, each power pack 40, 70 is slip fit between an adjacent pair of parallel mounts 16, which are bolted to the ram 12. As shown, each set of adjacent parallel supports defines a channel having an open end. In this regard, it will be noted that the power packs may be slidably received within the channel through the open end surface without removing a tool/die interconnected to the bottom surfaces of the parallel mounts. As shown, the die punch holder (e.g., the top of an individual die) may be mounted to the bottom surface of one or more parallel mounts 16 and adjacent to the bottom surface of one or more power packs. Likewise, an opposing portion of each die may be mounted to the press bed 14. Accordingly, when the ram 12 moves towards the generally press bed 14, the die parts are compressed together.

Figure 2:
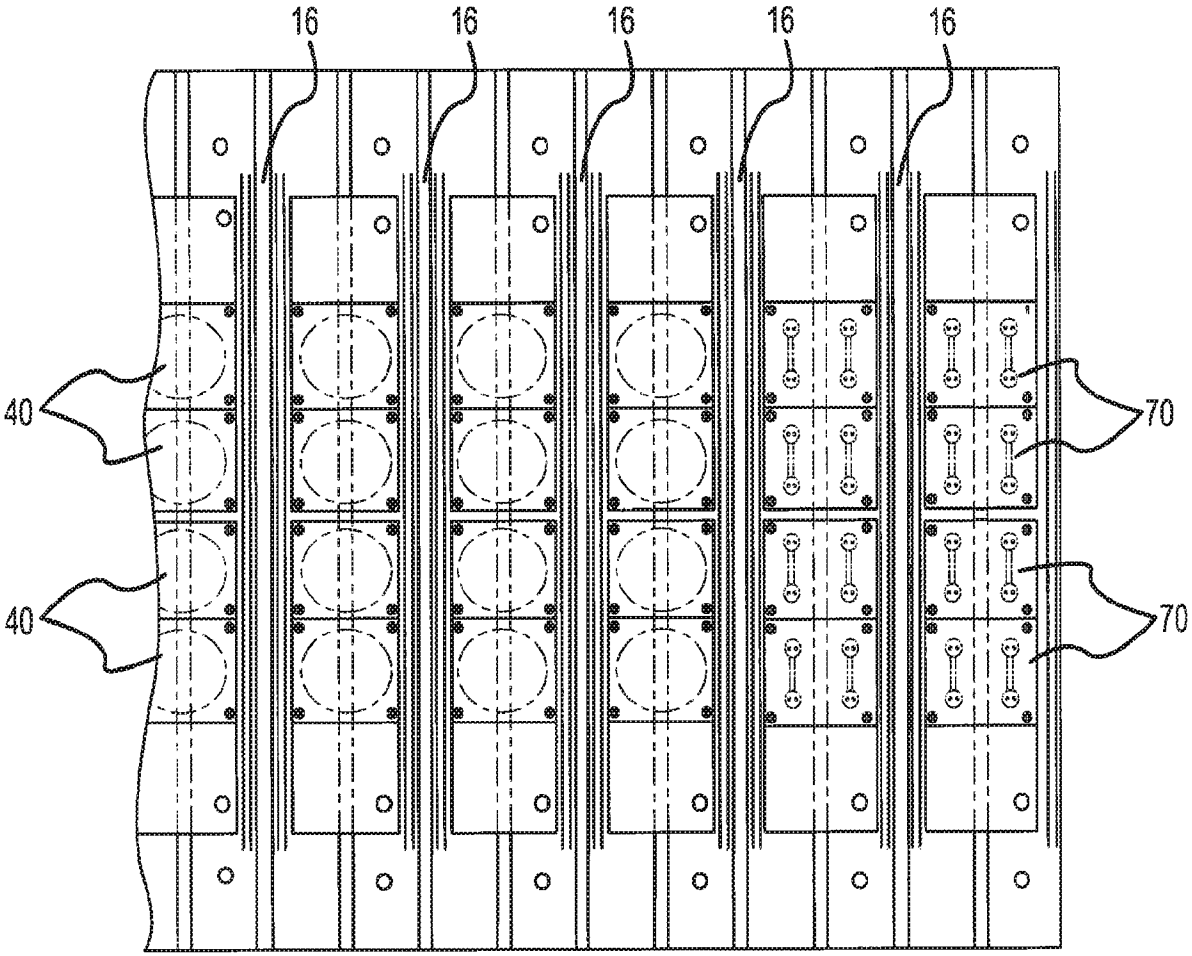
FIG. 2 is a bottom view of the ram of the press of FIG. 1.

FIG. 2 illustrates a bottom view of the ram 12. As shown, each pair of adjacent parallel mounts is sized to receive power pack 40, 70 therebetween. Further, the parallel mounts 16 may extend across the entire width of the rain 12 such that plurality of power packs may be disposed across the width of the ram 12 between each adjacent set of parallel mounts 16. Of further note, different types of power packs may be utilized. Such different types of power packs include passive power packs 40 utilizing compressible/resilient material such as, for example and without limitation, die rubber or urethane, as well as active power packs 70 that utilize compressed gas cylinders (e.g., nitrogen cylinders). In the latter regard, such active systems will typically be interconnected to a pressurization system.

Figure 3:
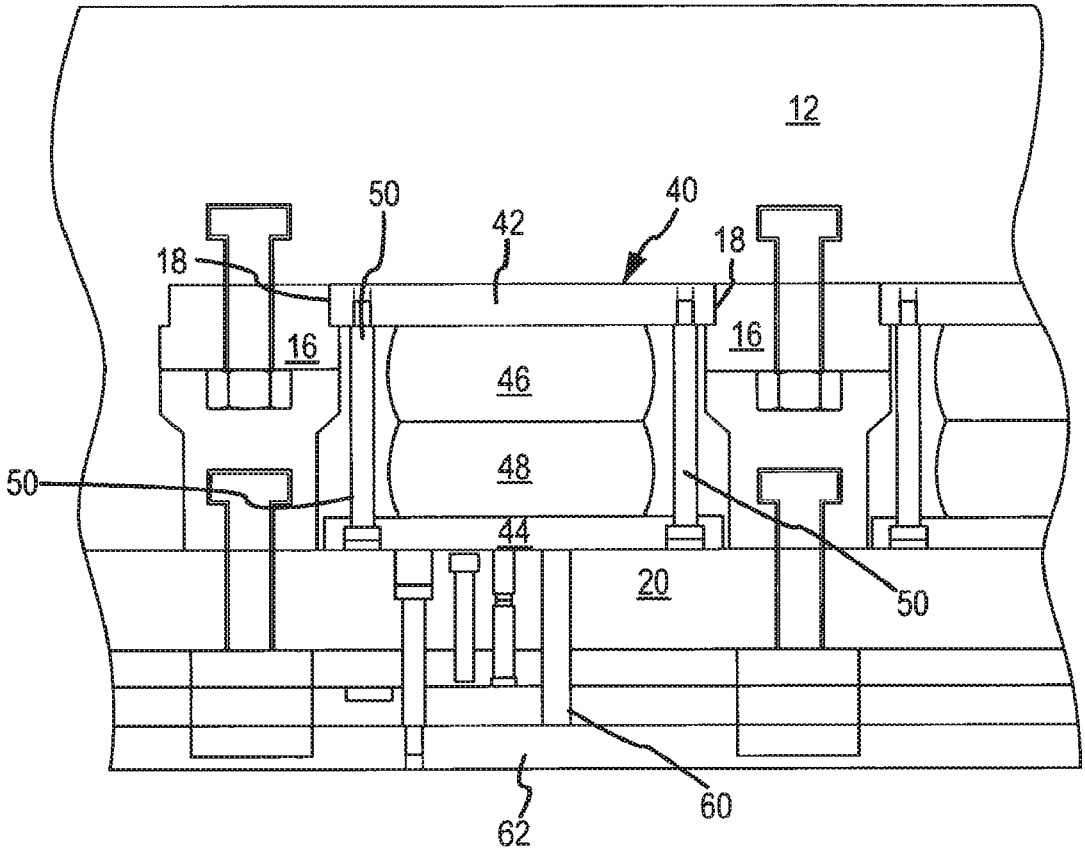
FIG. 3 illustrates one embodiment of a modular power pack.
Figure 4:
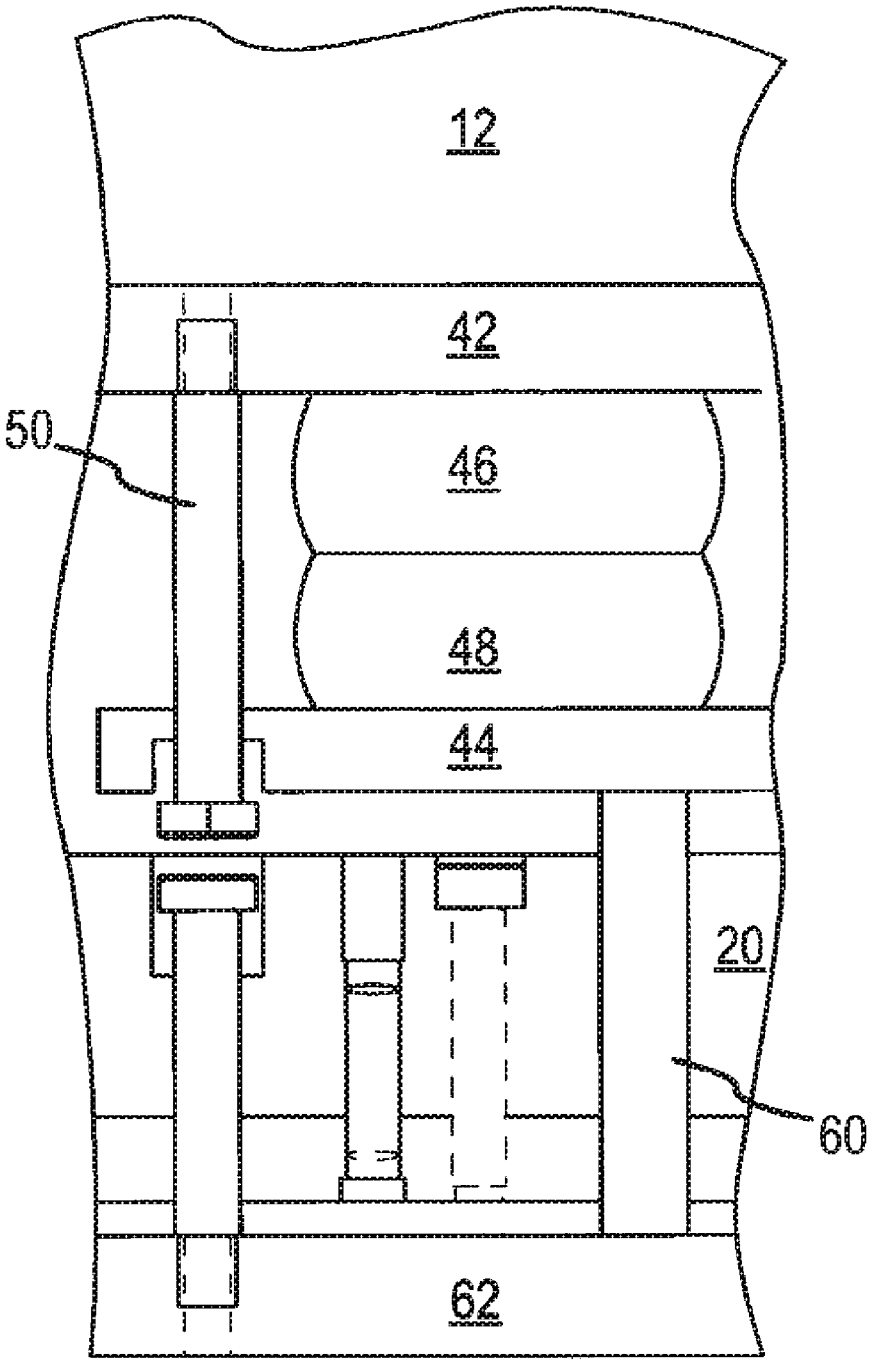
FIG. 4 illustrates compression of the modular power pack of FIG. 3.

FIGS. 3 and 4 illustrate connection of a passive power pack 40 between the press ram 12 and individual die plate/die punch holder 20, it will be appreciated that a die plate may cover the bottom surface of multiple or all of the pressure modules and parallel mounts and that multiple individual dies may be mounted to this plate. In such an arrangement, the die plate may include a plurality of apertures to permit access to the transfer plate 44 of the power packs, as will be discussed herein.

Though FIGS. 3 and 4 illustrate use of a passive power pack 40 with the system, it will be appreciated that following discussion is applicable to active power packs as well. The power packs utilized with any given press 10 may be sized such that, when mounted, the power packs are large enough to cover the widest and longest tools that are utilized with the press. Further, each power pack 40 is removable from the press and additional sets of power packs or power pack components may be available for exchange. In this regard, additional power packs or, for example, resilient members, having differing stripping pressures may be available for use with a single press or with multiple presses within a press facility. In this regard, additional power pack modules and/or components for use in the power packs may be constructed using various thicknesses (e.g., durometer hardness) of die rubber and/or urethane. This may allow for adjustment of stripping pressure supplied to a particular die/tool mounted below the pack.

As shown, the parallel mounts 16 are fixably connected to the ram 12. Further, in the present embodiment, the top edges of adjustment pairs of parallel mounts 16 define a T-slot that is sized to receive top plate 42 of an individual power pack 40. That is, the width of the top plate 42, the power pack 40 allows the power pack to be inserted between and vertically restrained by adjacent pairs of parallel mounts 16. In this regard, opposing edges of the top plate 42 are received within slip fit channels 18 of adjacent parallel mounts 16. As shown, the parallel mounts 16 are typically the same height as the height of the non-deformed power pack 40. Accordingly, a tool or die punch holder connected to the bottom of the parallel mounts 16 may be disposed adjacent to the transfer plate 44 of the power pack 40.

In the present embodiment, the power pack 40 utilizes first and second resilient members 46, 48 (e.g., die rubber/urethane) disposed between the top plate 42 and the bottom/transfer plate 44 of the power pack 40. The resilient members 46, 48 are operative to push the transfer plate 44 against the head of connecting bolts 50 that pass through the transfer plate 44 and are fixedly connected to the top plate 40. In one arrangement, each power pack 40 utilizes four connecting bolts 50. However, it will be appreciated that other configurations may be utilized as well.

In any arrangement, when the resilient members 46, 48 are compressed during operation of the ram 12, the transfer plate 44 is operative to move along the connecting bolts 50. (See FIG. 4.) In this regard, when the press is closed, a transfer pin 60 that extends through the die punch holder 20 to a die stripper plate 62 is forced against the transfer plate 44, which causes the resilient members 46, 48 to compress. When the press 10 is opened, the compressed resilient members 46, 48 are allowed to expand. Likewise, the transfer pin 60 is pushed back through the die punch holder 20 and forces the die stripper plate 62 away from the die punch holder 20. In this regard, a work piece disposed between the die set may be ejected from, for example, punches or other metal working portions of the die set. It will be further appreciated that additional various pins may extend through the die punch holder 20 to transfer plate 44. That is, transfer plate 44 may be operative to actuate one or more transfer pins. Further, the die punch holder 20 may hold one or more tools for use with a work piece.

Figure 5A:
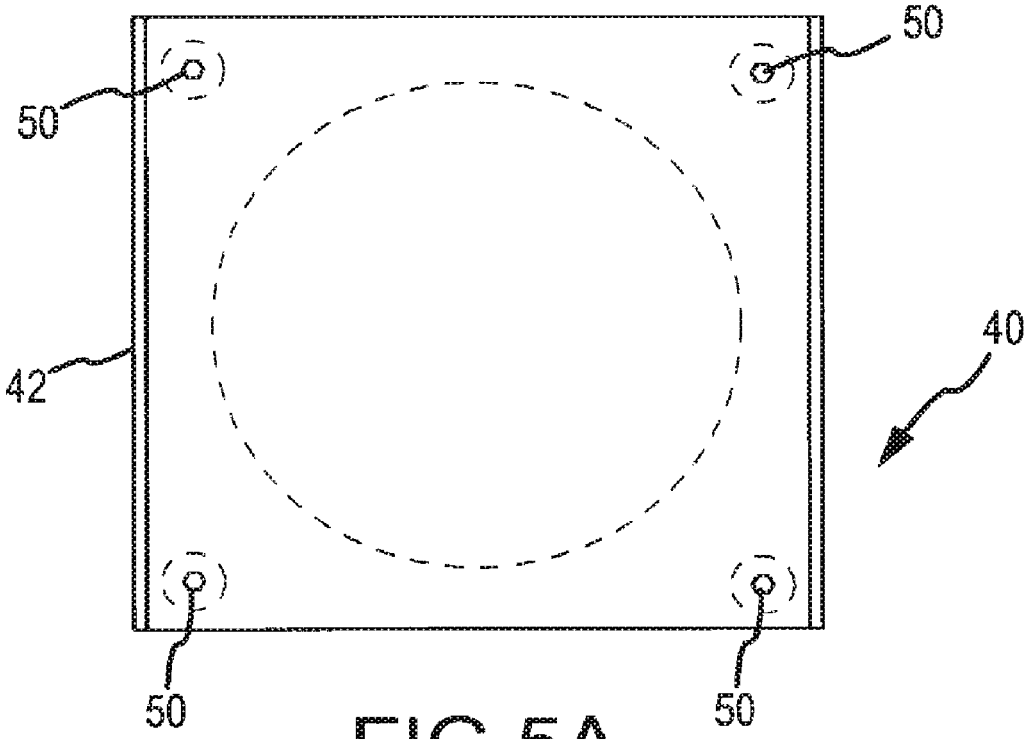
FIGS. 5*a* and 5*b* illustrate top and side views, respectively, of one embodiment of a passive power pack.
Figure 5B:
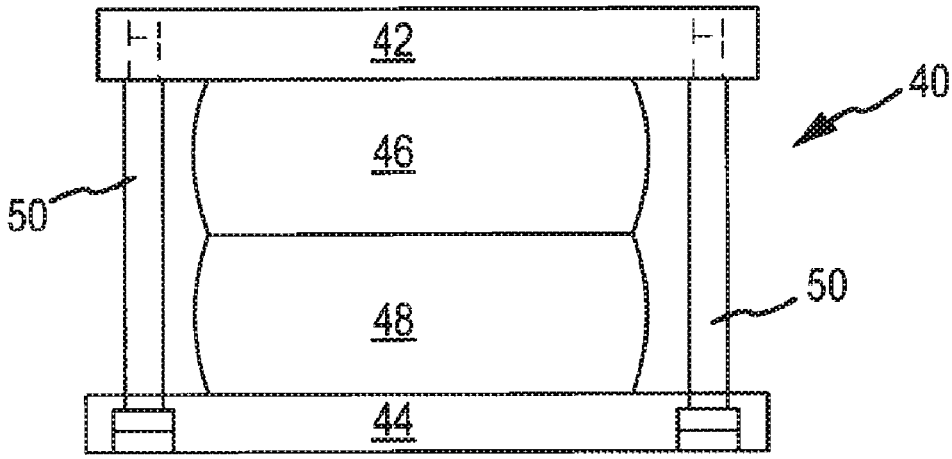

FIGS. 5A and 5B illustrate a top and side view of a passive power pack 40. As noted, the power pack 40 utilizes four connecting bolts 50 that interconnect the top plate 42 to the transfer plate 44. As further noted above, first and second resilient members 46, 48 are disposed between the top plate 42 and transfer plate 44. However, it will be appreciated that single resilient member or multiple resilient members may be disposed therebetween. Further, it will be appreciated that size and/or hardness of the resilient member(s) may be selected to generate a desired stripping force. In one arrangement, the resilient members 46, 48 may be removed from the power pack 40 to allow for replacement with other members having a desired compressibility.

Figure 6A:
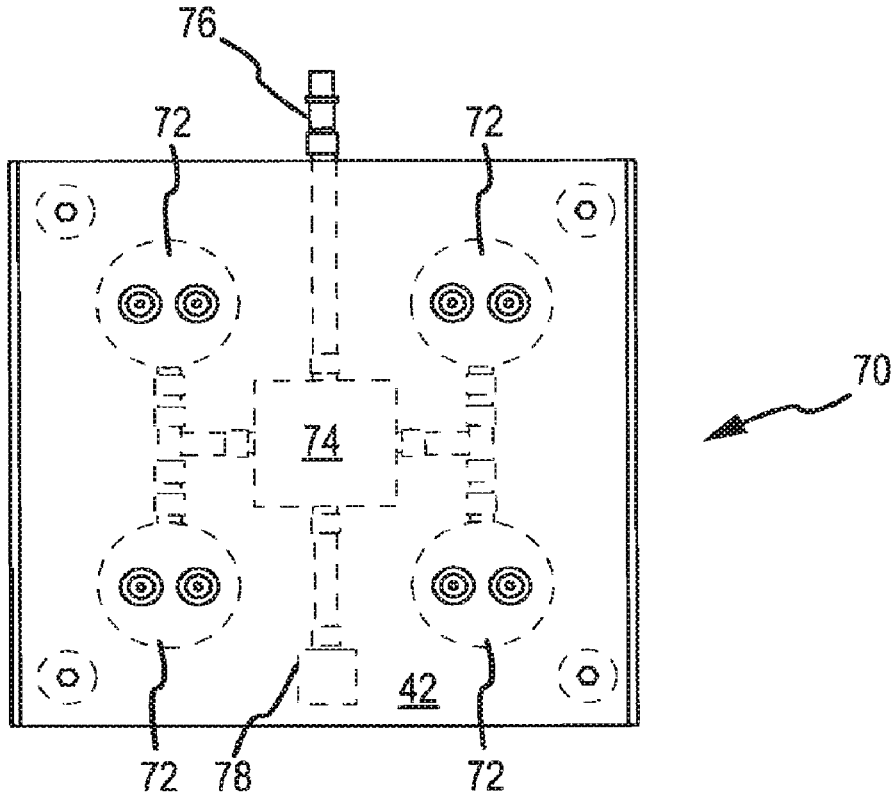
FIGS. 6*a* and 6*b* illustrate top and side views, respectively, of one embodiment of an active power pack.
Figure 6B:
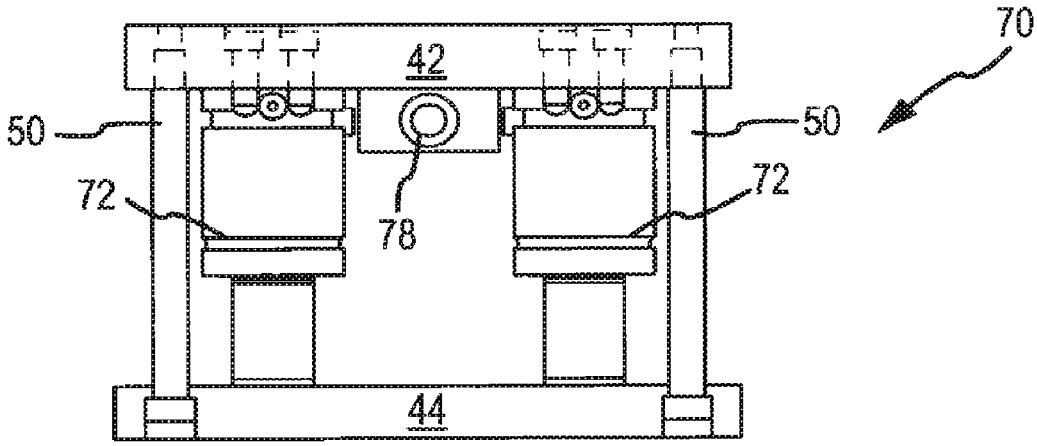

FIGS. 6A and 6B illustrate top and side views, respectively, of an active power pack 70. As shown, the active power pack 70 utilizes a top plate 42 and a transfer plate 44 that are connected by four connecting bolts 50 fixedly connected to the top plate 42 and passing through the transfer plate 44. However, rather than utilizing resilient members to provide an expansive force when compressed, the active power pack utilizes gas cylinders. Such cylinders may be activated utilizing high pressure nitrogen. In this regard, the cylinders 72 may have a first end fixedly connected to the top plate 42 and a bottom end that is operative to press against the transfer plate 44. In the present arrangement, each cylinder 72 is interconnected to a manifold 74 with appropriate fluid connections. To allow multiple active power packs 70 to by utilized in series (e.g., across the width of a ram 12), the manifold 74 includes an inlet connector 76 and an outlet connector 78. In this regard, the inlet connector 76 is operative to provide pressurized gas to the manifold 74 from a source of compressed gas. The outlet connector 78 (e.g., a female connector) is operative to maintain pressure within the manifold 74 when outlet connector 78 is not connected to an adjacent power pack. In contrast, when a second power pack is utilized in series with a first power pack, the inlet connector 76 of the second power pack may be inserted into the female connector of the first power pack. Of note, the inlet connector 76 may utilized a flexible line such that adjustment in the distance between power packs may be accounted for. In any case, an active power pack 70 may allow for individual valves (e.g., solenoid valves) to be used to allow pressure to be controlled from a remote controller.

It will be appreciated that the ability to readily change power packs in and out of a press may provide numerous benefits. For instance, the ability to readily change out power packs may reduce the time required to change die sets and/or change the materials (e.g., metal type and/or thickness) utilized with a die set. In this regard, a facility may stock a plurality of preset power pack modules (e.g., having a predetermined compressibility). Accordingly, such power packs may be utilized as needed with one or more presses within the facility. In addition, the facility may stock numerous different resilient members such that the compressibility of a given power pack may be adjusted for a particular application.

To further improve the workflow, a library of jobs may be created that provides setting information for a given press based on previous production runs of that or other presses. In this regard, the library of jobs may include the press location of one or more individual dies of a given tool as well as the required stripping force for each individual die. In this regard, the library of jobs may include the identification and location for each power pack/pressure module required by a particular tool. Accordingly, a user may select the appropriate power packs from a supply of preset power packs and/or adjust one or more power packs for job specific requirements. In any case, the use may insert the selected power packs into the press at the appropriate locations. In one arrangement, such a library jobs may be stored on computer readable storage medium accessible via the press. For instance, such information may be output on a user display associated with the press in response to one or more user inputs.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A modular pressure module for use with die strippers in a press, consisting essential of:

a rectangular top plate;

a rectangular transfer plate spaced from said top plate;

four connecting members extending between said plates, each connecting member being fixedly connected proximate to a separate corner of said top plate and passing through a corresponding corner of said transfer plate, wherein said transfer plate may move along at least a portion of the length of said connecting members, wherein in a first uncompressed orientation said transfer plate is disposed against an end stop on at least one of said connecting members to define an uncompressed distance between said plates; and at least one resilient clastomeric member having an uncompressed height substantially equal to said uncompressed distance between said plates and being disposed between said top plate and said transfer plate in an area within said four connecting members, where in a second compressed orientation, said transfer plate is disposed along the connecting members and compresses said resilient clastomeric member, wherein a distance between at least two of said connecting members is greater than a width of said resilient elastomeric member allowing said resilient clastomeric member to be removed from or inserted between said plates when said plates are in said first uncompressed orientation.

2. The device of claim 1, wherein said resilient member is disposed between said plates free of direct mechanical connection.

3. A press for use in a die pressing process, comprising:

a press bed;

a ram disposed in a spaced relationship to said press bed and being movable relative to said press bed;

first and second elongated mounts extending across at least a portion of the width of a substantially planar surface of one of said ram and said press bed and being disposed in a spaced and parallel relationship wherein facing side surfaces of said elongated mounts and said planar surface define a pressure module receiving channel, said mounts each having a first end fixedly connected to said surface a second free end extending above said planar surface, wherein said second free ends of said mounts define a reference plane;

at least one pressure module having a top plate a transfer plate and a resilient member disposed between said top plate and said bottom plate, wherein a width of said plates are sized for slidable receipt within said channel between said facing side surfaces of said first and second elongated mounts, wherein said top plate is disposed proximate to said planar surface and said transfer plate is disposed proximate to said reference plane.

4. The device of claim 3, wherein at least one end of said channel is an open end, wherein said pressure module may be received and removed from said open end of said channel.

5. The device of claim 3, further comprising:

a die plate connected to said second ends of said elongated mounts and extending over said pressure module receiving channel between said elongated mount, wherein said die plate includes at least a first aperture to permit communication between a stripper mechanism attached to the die plate and said pressure module.

6. The device of claim 3, wherein each said side surface further comprises:

a lip for engaging an edge of said top plate of said pressure module, wherein said lip restrains movement of said pressure module in at least a first direction.

7. The device of claim 3, wherein said pressure module receiving channel is sized to receive at least first and second pressure modules.

8. The device of claim 3, further comprising:

a plurality of parallel elongated mounts disposed in a spaced and parallel relationships wherein facing side surfaces of each set of adjacent elongated mounts define a channel, wherein each channel may receive at least one pressure module.

9. The device of claim 3, further comprising:

a pressurized gas system, wherein said pressurized gas system is in fluid communication with said pressure module.

* * * * *

UNITED STATES PATENT AND TRADEMARK OFFICE

CERTIFICATE OF CORRECTION

PATENT NO. : 7,765,847 B2
APPLICATION NO. : 11/934559
DATED : August 3, 2010
INVENTOR(S) : Michonski It is certified that error appears in the above-identified patent and that said Letters Patent is hereby corrected as shown below:

Column 8, line 24, after "surface", insert --and--.
Column 8, line 7, after "plate", insert --,--.

Signed and Sealed this

Twenty-sixth Day of October, 2010

David J. Kappos

David J. Kappos
*Director of the United States Patent and Trademark Office*